US007864003B2

(12) United States Patent
Yang

(10) Patent No.: US 7,864,003 B2
(45) Date of Patent: Jan. 4, 2011

(54) CIRCUIT BREAKER LOCKING AND UNLOCKING MECHANISM

(75) Inventor: Guang Yang, Duluth, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 236 days.

(21) Appl. No.: 12/360,394

(22) Filed: Jan. 27, 2009

(65) Prior Publication Data

US 2009/0189719 A1 Jul. 30, 2009

Related U.S. Application Data

(60) Provisional application No. 61/024,213, filed on Jan. 29, 2008.

(51) Int. Cl.
*H01H 75/00* (2006.01)

(52) U.S. Cl. ..... 335/6; 335/13; 335/157; 335/158; 324/424

(58) Field of Classification Search ..... 335/6, 335/13, 15, 156–158; 324/415–424; 200/43.01–43.22
See application file for complete search history.

(56) References Cited

U.S. PATENT DOCUMENTS

2002/0135960 A1 9/2002 Bernstein
2003/0016101 A1 1/2003 Calixto et al.

*Primary Examiner*—Ramon M Barrera
(74) *Attorney, Agent, or Firm*—Jose R. de la Rosa

(57) ABSTRACT

A circuit breaker and method include main contacts configured to connect in an on position and be separated in an off position. A handle is coupled to one of the main contacts to adjust the contacts between the on position, the off position, a trip position and an over on position. Secondary contacts are configured to provide power when connected using the handle in the over on position, even when the main contacts are separated. A stop mechanism configured to maintain separation between the main contacts to enable testing using the secondary contacts to power a test circuit such that if a test passes, the stop mechanism is released to permit resetting of the main contacts.

19 Claims, 13 Drawing Sheets

CIRCUIT BREAKER LOCKING AND UNLOCKING MECHANISM

RELATED APPLICATION INFORMATION

This application claims priority to Provisional Application Ser. No. 61/024,213 filed on Jan. 29, 2008, incorporated herein by reference.

BACKGROUND

1. Technical Field

This disclosure relates to circuit breakers, and more particularly, to a circuit breaker mechanism and method that locks and unlocks a movable arm of the circuit breaker.

2. Description of the Related Art

Electronic circuit breakers, such as arc fault circuit interrupters (AFCIs) and ground fault circuit interrupters (GFCIs), use electronic parts to detect arc and ground faults. Once the electronic components fail, the breaker may lose its ability to protect the electrical circuit.

It would be advantageous to be able to check the electronic components or electronic breakers before turning on the breaker back on (e.g., closing the main contacts) for safety purposes.

SUMMARY OF THE INVENTION

A circuit breaker and method include main contacts configured to connect in an on position and be separated in an off position. A handle is coupled to one of the main contacts to adjust the contacts between the on position, the off position, a trip position and an over on position. Secondary contacts are configured to provide power when connected using the handle in the over on position, even when the main contacts are separated. A stop mechanism configured to maintain separation between the main contacts to enable testing using the secondary contacts to power a test circuit such that if a test passes, the stop mechanism is released to permit resetting of the main contacts.

A circuit breaker includes a moving arm having a moveable contact connecting to a fixed contact when in an on position and separated from the fixed contact in an off position. A handle is coupled to the moving arm to adjust the moving arm into the on position, the off position, a trip position and an over on position. Secondary contacts are configured to provide power to a test circuit, the secondary contacts being connected by the handle when in the over on position. A moving arm stop is configured to maintain separation between the moveable contact and the fixed contact when the handle is in the over on position. The moving arm stop is releasable in accordance with a signal from the test circuit generated when the secondary contacts are connected such that the moving arm stop releases the moving arm if the test circuit determines that the breaker is suitable for operation.

A method for powering circuit breaker electronics includes providing a circuit breaker having connectable main contacts wherein the main contacts connect in an on position and are separated in an off position and a trip position, a handle coupled to one of the first contacts to adjust the contacts between the on position, the off position and an over on position, secondary contacts configured to provide power when connected using the handle in the over on position, and a stop mechanism configured to maintain separation between the main contacts until a condition is met; connecting the secondary contacts by applying the handle in the over on position; and powering a circuit within the circuit breaker such that if the condition is met as determined by the circuit, the stop mechanism is released to permit resetting of the connectable main contacts, otherwise the stop mechanism is maintained and the main contacts remain separated.

These and other objects, features and advantages of the present invention will become apparent from the following detailed description of illustrative embodiments thereof, which is to be read in connection with the accompanying drawings.

BRIEF DESCRIPTION OF DRAWINGS

This disclosure will present in detail the following description of preferred embodiments with reference to the following figures wherein.

DETAILED DESCRIPTION OF PREFERRED EMBODIMENTS

The present principles include a method for locking mechanical parts of a circuit breaker, and hence prevent closing main contacts with failed electronic components. Then, a temporarily resumption of power is provided to the electronic components. After the power is resumed, the electronic components perform self testing. If the electronic components pass the test, the present embodiments unlock a mechanical pole and allow the main contacts to be closed.

While the present embodiments will be described in terms of an illustrative circuit breaker type and a corresponding mechanism, the present principles are not limited to the illustrative example and may be employed with other electronic and mechanical elements including elements having similar or equivalent functions. Such devices may include, for example, AFCI, GFCI, TVSS, Surge, switching devices, etc. The functions of the various elements shown in the figures can be provided through the use of dedicated hardware as well as hardware capable of performing one or more of the described functions.

Embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure). Thus, for example, it will be appreciated by those skilled in the art that the block diagrams presented herein represent conceptual views of illustrative system components and/or circuitry embodying the principles of the invention.

Figure 1:
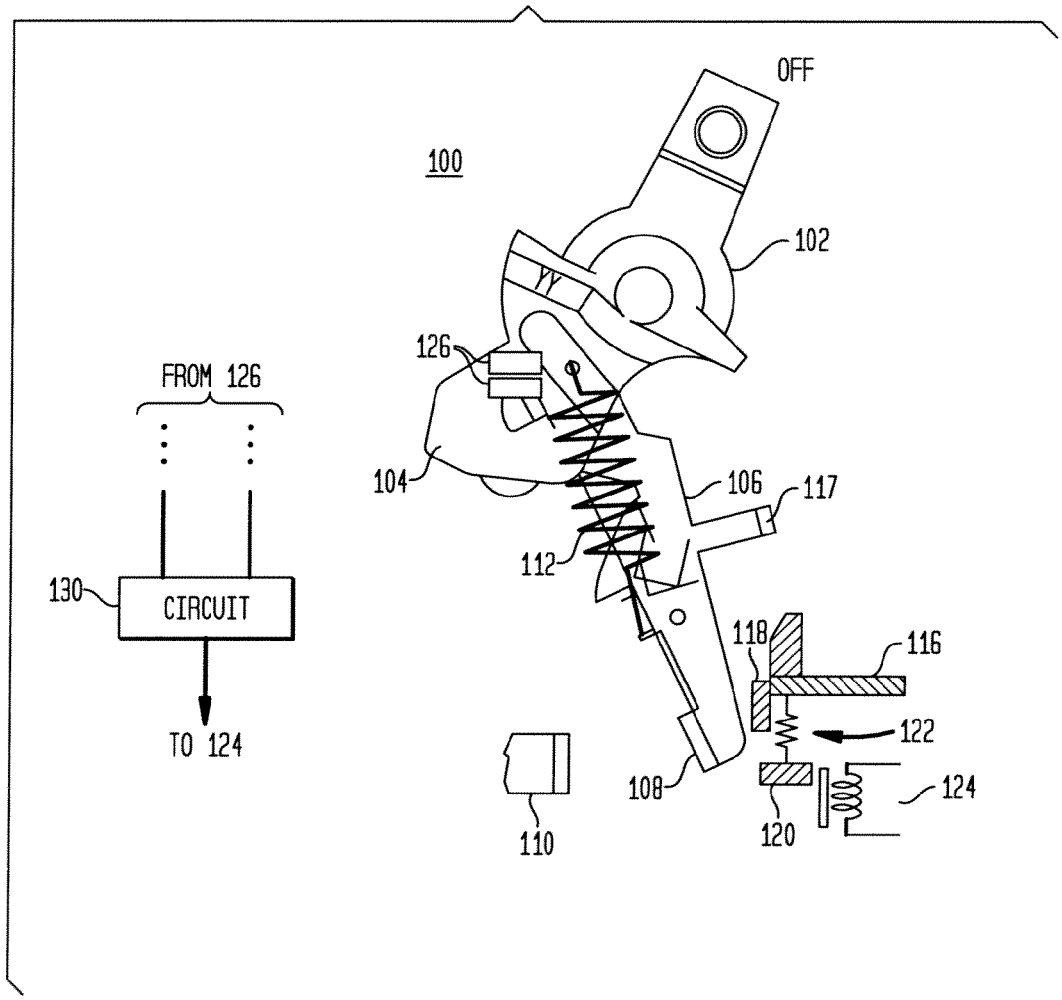
FIG. 1 is a schematic diagram showing a circuit breaker mechanism in an off position with main contacts open in accordance with the present principles.

Referring now in specific detail to the drawings in which like reference numerals identify similar or identical elements throughout the several views, and initially to FIG. 1, a mechanism for a circuit breaker 100 is illustratively shown in accordance with one embodiment. The circuit breaker 100 includes a handle 102 having an extended portion 104 that pivotally connects to a moving arm 106. The moving arm 106 includes a moveable contact 108 that is moveable relative to a fixed contact 110. The fixed contact 110 and the moveable contact are separated when in the "off" state as depicted in FIG. 1. The off state is set by placing the handle 102 in the off position to separate the fixed contact 110 from the moveable contact 108 (collectively referred to as first or main contacts) by causing the angular displacement of the moving arm 106.

A biasing device 112, such as a spring, is connected to the moving arm 106 and a cradle (not shown). The cradle (111) is removed for clarity, but is explained with reference to FIGS. 11-13. The biasing device 112 applies a force to the moving arm 106 to maintain the moving arm 106 in a retracted position relative to the fixed contact 110. In this way, the fixed contact 110 and the main contact 108 remain separated.

In this embodiment, a moving arm stop 116 is biased upward and guided using support structures 118 and 120. The moving arm stop 116 is designed to "always block" the moving arm 106 unless secondary contacts 126 trigger an actuator or release which moves the blocking area of stop 116 out of the way (e.g., a spring or other element moves the blocking device away or back into its blocking position). Support structures 118 and 120 may be molded into a housing of the circuit breaker or provided as a separate insert. Support structure 118 maintains the position of the moving arm stop 116 and permits guided motion thereof. Support structure 120 provides an attachment point for a biasing device 122. Moving arm stop 116 is configured to receive a latch 117 rigidly formed on moving arm 106. The latch 117 is positionable to catch on the stop 116 to hold the moving arm 106 in a predetermined position. A relay 124 provides a magnetic field in accordance with a circuit 130 to actuate the stop 116 as will be explained in greater detail below.

A pair of secondary contacts 126 is provided at or near the breaker handle 102. These contacts 126 are maintained in an open position and are biased apart. The contacts 126 may be biased apart using a biasing device between the positions on which the contacts are mounted, or the resiliency of at least one of the contacts 126 may be employed as a biasing feature (e.g., the elastic response of the conductive material which may act as a beam or cantilever spring). Upon connection of contacts 126, the circuit 130, which may be a self-test circuit, is powered to test the breaker 100 to determine if it is safe to close the main contacts (108, 110) again. If the test passes, a signal is provided to relay 124 or other device to put the stop 116 in a desired state. This is particularly useful with ground or arc fault protection circuits.

Figure 2:
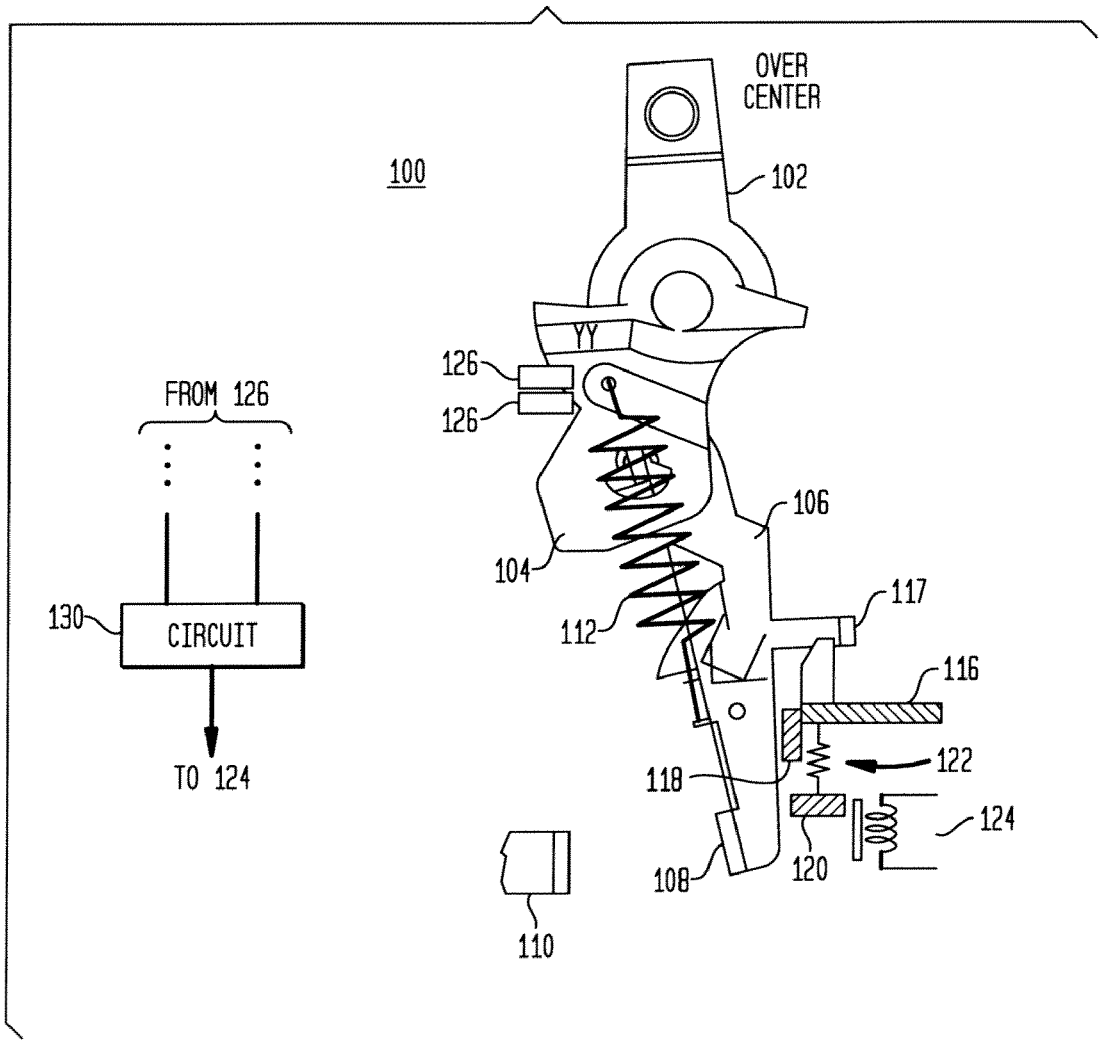
FIG. 2 is a schematic diagram showing the circuit breaker of FIG. 1 where a latch of a moving arm engages a moving arm stop in an over center position with main contacts open in accordance with the present principles.
Figure 3:
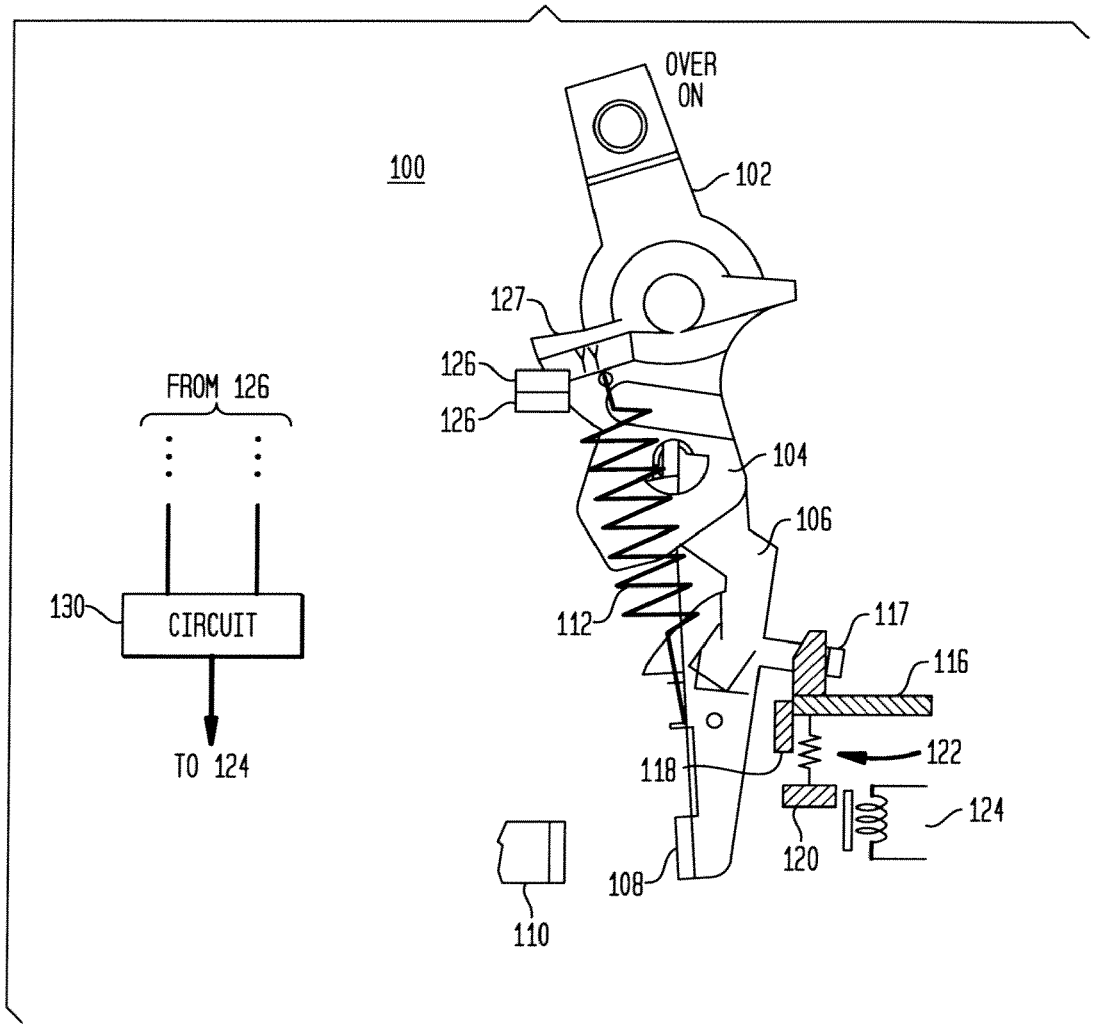
FIG. 3 is a schematic diagram showing the circuit breaker of FIG. 2 where secondary contacts are connected to power an on-breaker circuit in an over on position where the moving arm stop maintains the moving arm with main contacts open in accordance with the present principles.

Referring to FIG. 2, the handle 102 is rotated to an over center position or other fixed position between the off and on positions. When in the over center position, the moving arm stop 116 is employed to block the moving arm 106 as the user turns the handle, and therefore locks the mechanical parts of the breaker 100, and, in particular, the moving arm 106 by catching the latch 117 on the stop 116. When the electronic components pass a self test conducted using circuit 130, the moving arm stop 116 is removed and the breaker is unlocked. The pair of secondary contacts 126 is provided for the purpose of the electronic power resumption. Temporary power resumption enabled by secondary contacts 126 is preferably limited to the electronics and does not supply power to the load side of the circuit breaker 100. The secondary contacts 126 are normally open, unless pressed with a portion 127 of the breaker handle 102 as depicted in FIG. 3. The electronics 130 may include any self test logic or other testing circuits to determine whether the breaker can be used again.

The moving arm stop 116 is preferably made of ferromagnetic material and is loaded with a compression spring 122. When the user turns the handle 102, the moving arm 106 is rotated to the location as shown in FIG. 2. In FIG. 2, the breaker handle 102 is at a transition position of the breaker operation (e.g., over center). At this position, the operation spring 112 has been stretched and has gained enough energy to close the main contacts 108 and 110 when the moving arm 106 is released. If the handle slightly passes the over center position, the operation spring 112 closes the main contacts 108 and 110, if the arm 106 has been released from the stop 116. The moving arm stop 116 is placed at this over center position to block the motion of the moving arm 106 in the horizontal direction. The over center position is where engagement between the moving arm 106 and the moving arm stop 116 is achieved.

Referring to FIG. 3, the handle 102 is turned to the on position. If the user continues passed the on position, (an over on position is reached as shown), the handle presses the secondary contacts 126 using portion 127. This closes the secondary contacts 126 and resumes power to electronic components 130 present in the circuit breaker to perform self-testing or other functions.

Figure 4:
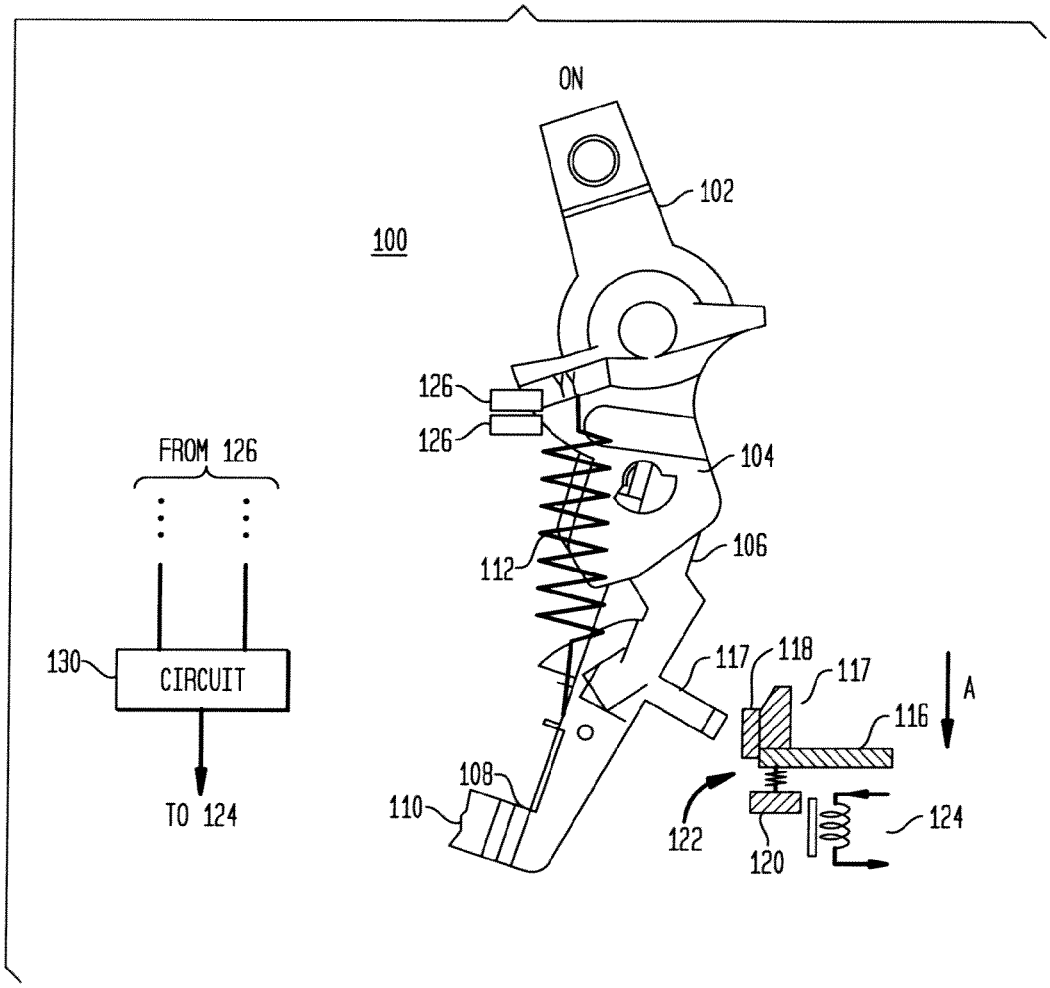
FIG. 4 is a schematic diagram showing the circuit breaker of FIG. 3 where the on-breaker circuit unlocks the moving arm stop to release the moving arm to permit resetting of the main contacts in the on position in accordance with the present principles.

Referring to FIG. 4, if the electronic components 130 pass the self-test, the self-test electronics enable a current to flow through the relay 124 to generate a magnetic force. The moving arm stop 116 is attracted by the magnetic force and moves down in the direction of arrow "A" to release the latch 117 of the moving arm 106. The operation spring 112 is then released and deflects to close the main contacts 108 and 110. After the main contacts 108 and 110 are closed. The spring force on the secondary contacts 126 will automatically send the handle 102 from the over on position (FIG. 3) back to the on position (FIG. 4). The contacts 108 and 110 are connected, and the breaker is operational.

If the electronic components 130 fail the self-test, the device does nothing. The user can then release the handle, and the handle automatically moves back to the off position using the operation spring 112. The operation spring 112 maintains the moving arm 106 such that the contacts 108 and 110 remain separated as depicted in FIG. 1.

Figure 5:
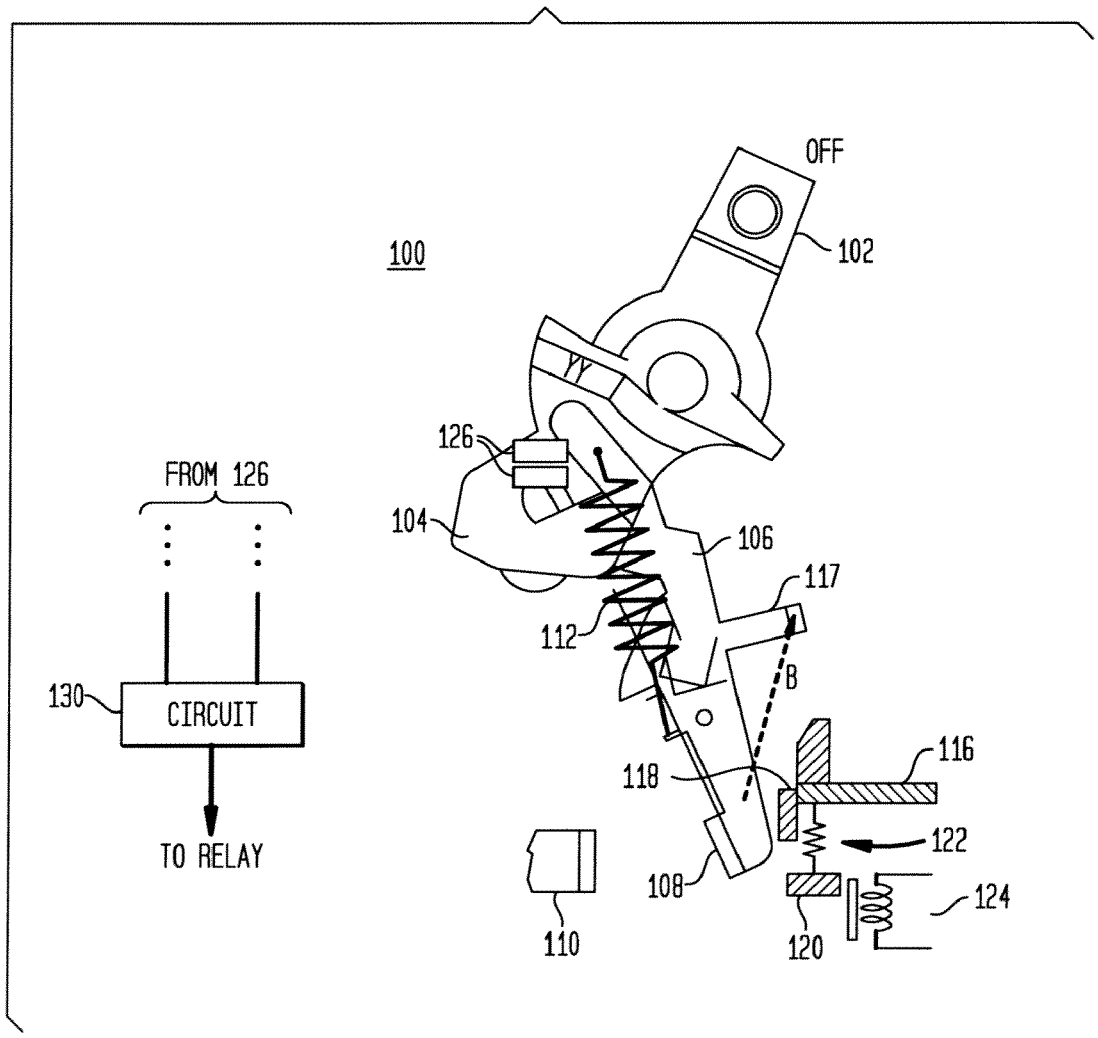
FIG. 5 is a schematic diagram showing the circuit breaker of FIG. 4 where the handle is moved from on to off in accordance with the present principles.

When the breaker 100 is on, there are two ways to separate the main contacts 108 and 110. In a first way, the main contacts 108 and 110 can be separated by turning the handle 102 from the on position to the off position. In the motion from on to off, the moving arm 106 does not interfere with the moving arm stop 116, as indicated by dashed arrow B in FIG. 5. The latch 117 passes by the stop 116 without engaging the stop 116. A second way to separate the contacts 108 and 110 is to trip the breaker.

Figure 6:
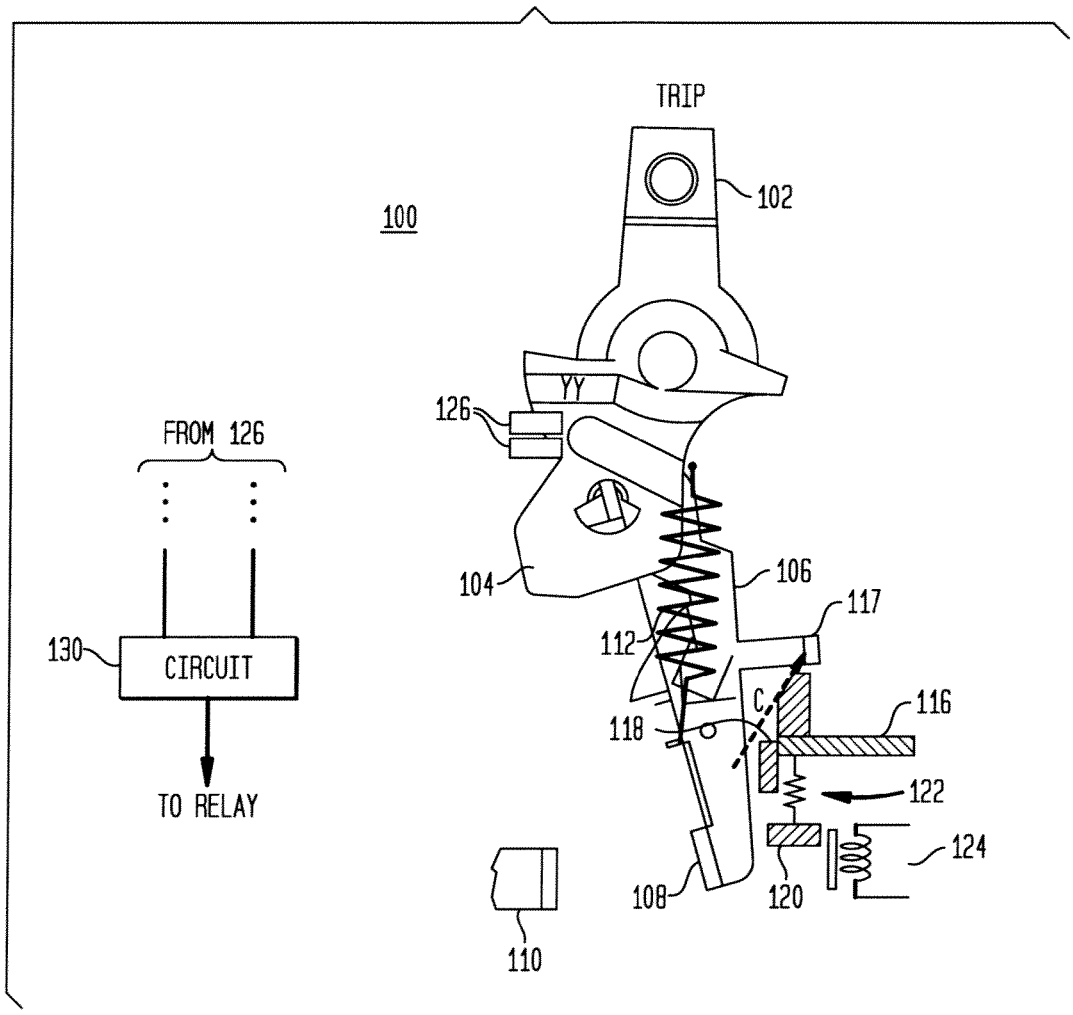
FIG. 6 is a schematic diagram showing the circuit breaker of FIG. 4 where a path taken by the moving arm is shown after a trip in accordance with the present principles.

Referring to FIG. 6, when the breaker is tripped, the handle goes to a trip position, and the moving arm 106 follows the path indicated by the dashed arrow "C". The moving arm 106 interferes with the moving arm stop 116. To ensure the moving arm 106 passes the moving arm stop 116, one side 134 of the stop 116 is radiused, chamfered or sloped. Hence, as the moving arm 106 engages the side 134, the stop 116 is forced downward and makes clearance for the latch 117 to pass. The moving arm 106 therefore is tripped by moving away from the fixed contact 110 and causes an open circuit. The breaker 100 can be reset by first moving the handle 102 to the off position followed by the over center position followed by the on position as described above. As the over center position is achieved, the stop 116 is latched by latch 117.

To close the main contacts 108 and 110, the handle 102 is turned from an off position to an on position (FIG. 4). The stop 116 blocks the motion of the moving arm 106 when the handle 102 is turned from off to on. As described the main contacts 108 and 110 can be separated when a user turns the handle from on to off, or, when an over load current occurs, the breaker 100 reacts and trips. In the tripping process, the handle 102 automatically goes to a trip position (FIG. 6). From the trip position, the user cannot directly close the main contacts 108 and 110. The handle has to be moved to the off position first, and then the main contacts 108 and 110 can be closed. As above, the handle 102 is also engaged in the motion from on to trip, and the motion from trip to off.

It is to be understood that the arrangement/configuration of the moving arm 106, the moving arm stop 116, the biasing device 112, the relay 124 and the secondary contacts 126 may have numerous variations. Other configurations can also be realized as will illustratively be described and shown with reference to FIGS. 7-10.

Figure 7:
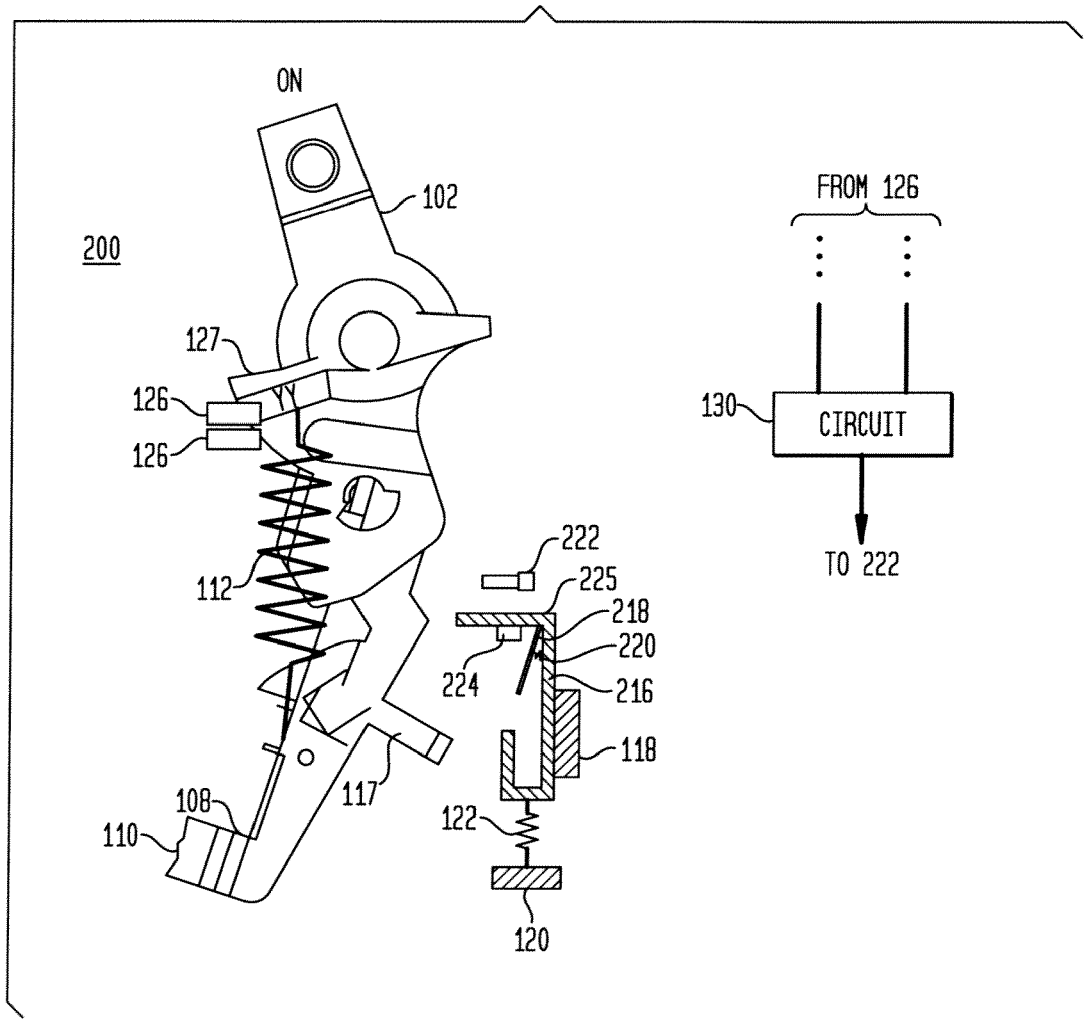
FIG. 7 is a schematic diagram showing an alternative circuit breaker where a moving arm and handle are in an on position with main contacts closed in accordance with the present principles.

Referring to FIGS. 7-10, four positions are shown for an alternative configuration of a circuit breaker 200. In FIG. 7, when the breaker 200 is on (main contacts 108 and 110 are closed). A moving arm stop 216 now includes a loop shape, and is held with an extension spring 122. A moveable latch 218 is placed on the moving arm stop 216, and is loaded with a compression spring 220 or other biasing device. The latch 218 can only rotate counter clockwise in this configuration by further compressing spring 220, and cannot rotate clockwise (latch 218 is pivoted (pivot 225) where connected to stop 216). The moving arm stop 216 is configured to permit clearance for a solenoid plunger 222 and its motion. It should be understood that other mechanisms may be employed as well instead of or in addition to solenoid plunger 222.

Figure 8:
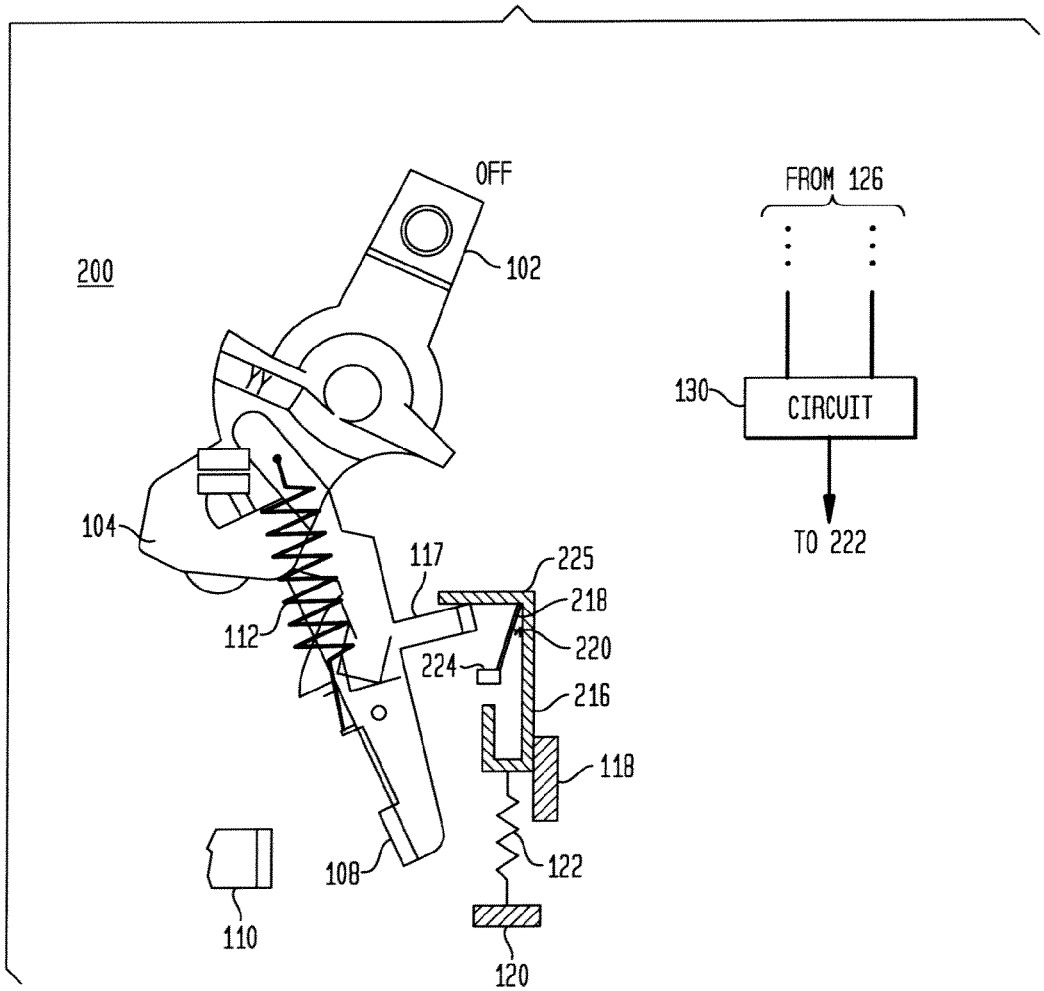
FIG. 8 is a schematic diagram showing the circuit breaker mechanism of FIG. 7 in an off position with main contacts open in accordance with the present principles.

The solenoid plunger 222 can fire to trip the breaker 200 when the main contacts 108 and 110 are closed. When the user turns the breaker handle 102 to the off position as illustrated in FIG. 8, the moving arm 106 pushes the moving arm stop 216 upward. As the moving arm stop 216 meets a blocking structure 224 (e.g., structure formed in the housing of the breaker 200), the interaction force between the structure 224 and the latch 218 compresses spring 220 and makes the moving arm stop 216 pass the blocking structure 224 and reach a position above the blocking structure 224, as shown in FIG. 8.

Although the extension spring 112 exerts force on the moving arm stop 216 downward, the downward motion of the stop 216 is not possible due to the interaction between the latch 218 and the blocking structure 224. When the user turns on the breaker 200, the handle 102 is pulled from the off position to the on position.

Figure 9:
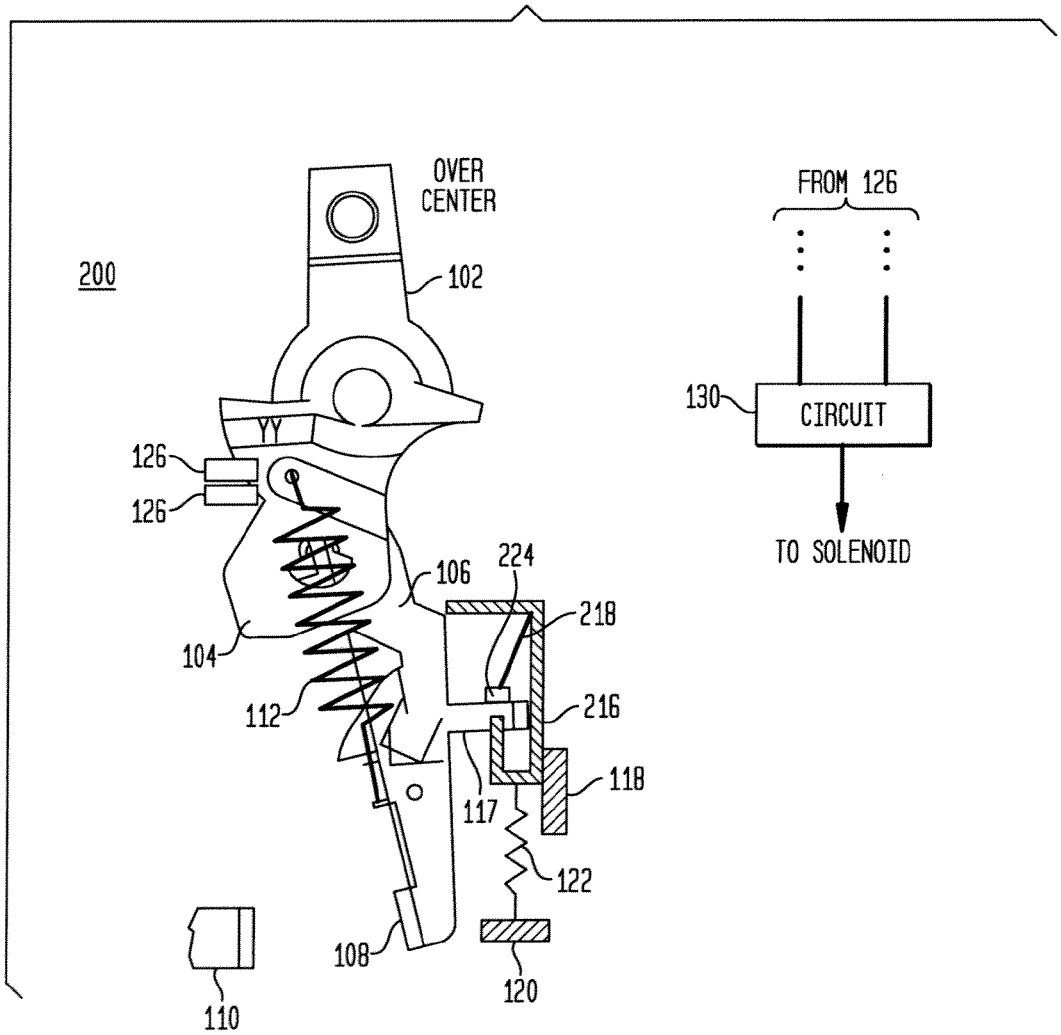
FIG. 9 is a schematic diagram showing the circuit breaker of FIG. 8 where a moveable latch of a moving arm stop prevents movement of the moving arm in an over center position with main contacts open in accordance with the present principles.

As described above for the previous configuration, the handle 102 first reaches an over center position. The moving arm stop 216 blocks the horizontal motion of the moving arm 106 at this position, as depicted in FIG. 9. The latch 117 is held by a portion of the stop 216. As the user keeps turning the handle 102, an over on position is achieved where the secondary contacts 126 are pressed together to cause current flow. This resumes power to the electronic components 130 and performs self testing.

Figure 10:
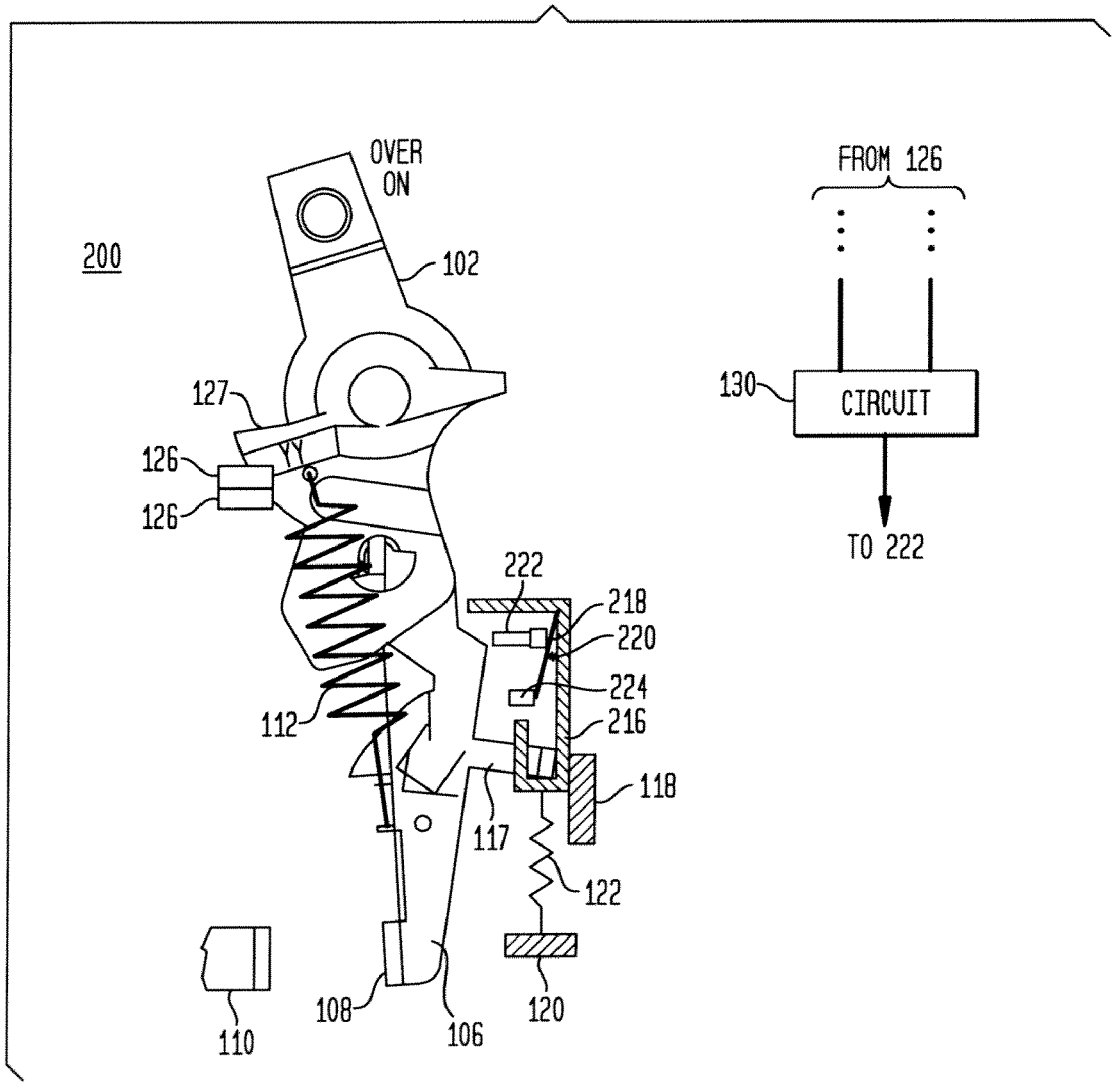
FIG. 10 is a schematic diagram showing the circuit breaker of FIG. 9 where secondary contacts are connected to power an on-breaker circuit in an over on position where the moving arm stop maintains the moving arm with main contacts open in accordance with the present principles.

Referring to FIG. 10, since the moving arm stop 216 is now at a higher position, the moving arm stop 216 goes into the motion path of the solenoid plunger 222. If the breaker 200 passes the test, a solenoid of the solenoid plunger 222 in the breaker fires and hits the latch 218 on the moving arm stop 216. This releases the spring 220 to draw the stop 216 downward by the spring force. The moving arm 106 is then released and is moved to the on position by the release of the operation spring 112 (see, e.g., FIG. 7).

If the breaker fails the self test, the device does nothing. As the user releases the handle 102, the operation spring 112 shrinks and moves the moving arm 106 and the handle 102 to off position. In this alternative configuration, instead of a relay 124, the unlocking mechanism is the solenoid plunger 222 which may already exist in the device.

Figure 11:
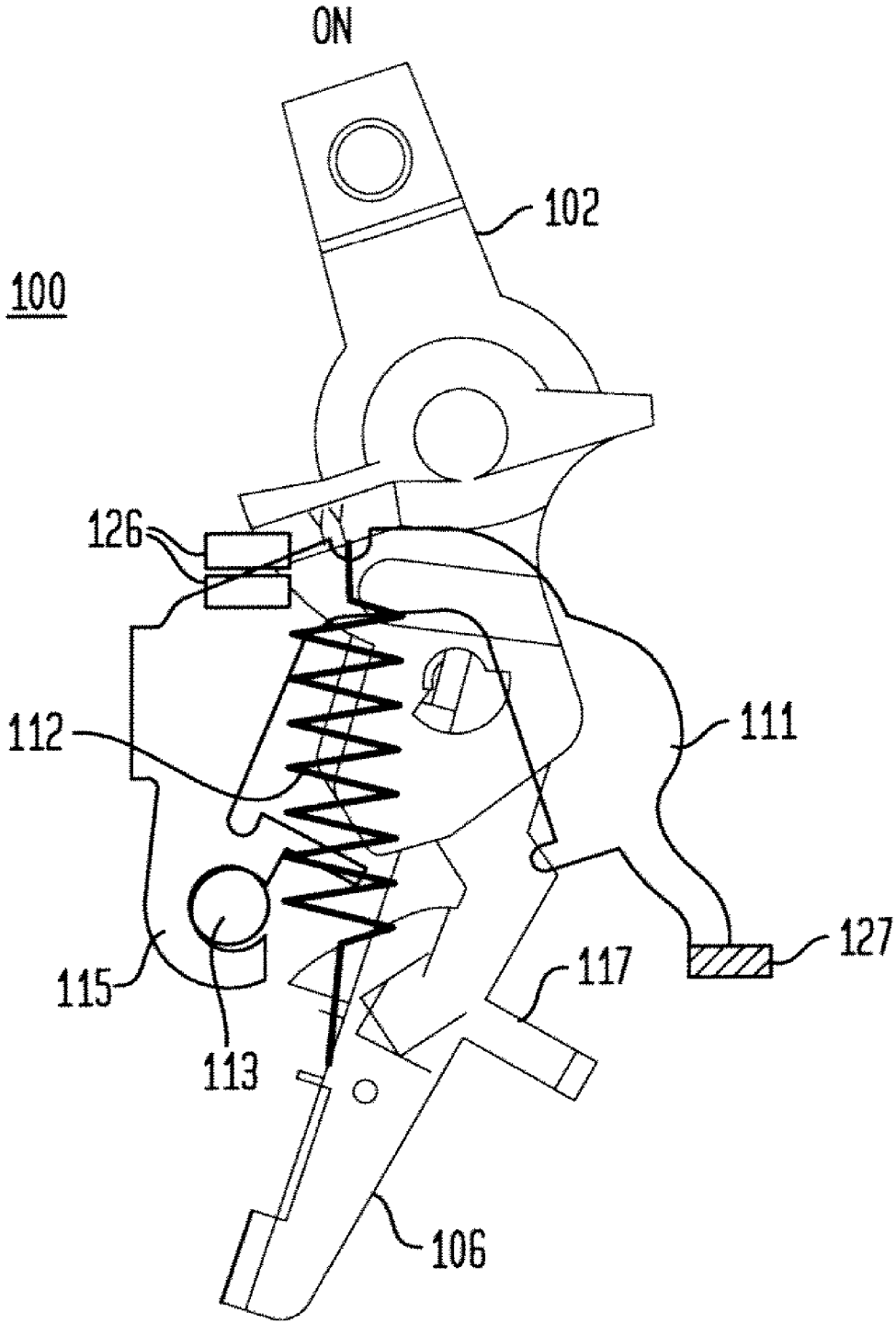
FIG. 11 is a schematic diagram showing the circuit breaker of FIG. 3 where a cradle component is illustratively described in the on position in accordance with the present principles.

Referring to FIG. 11, it should be understood that one side of the spring 112 is hung on the contact arm 106, while the other side is hung on a component called a cradle 111. The cradle 111 pivots about a post 113 inside the breaker, so that it can rotate when necessary. When the breaker is at the on position, the spring 112 tends to rotate the cradle 111 clockwise. However, a foot 115 of the cradle sits on a latch 127 inside the breaker. Therefore, the rotation is not possible and the cradle 111 stays stationary. The cradle 111 has been omitted from FIGS. 1-10 for clarity.

Figure 12:
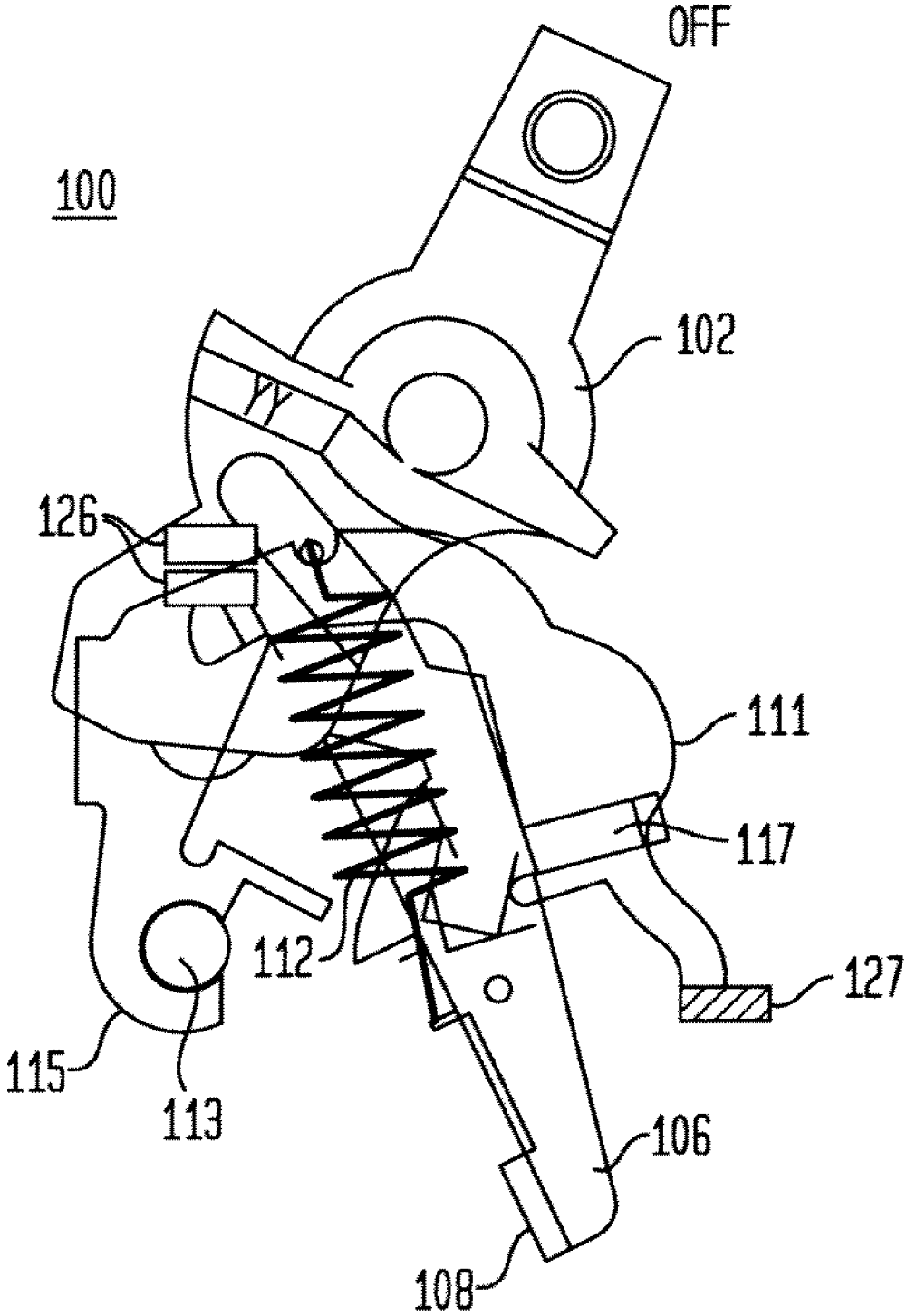
FIG. 12 is a schematic diagram showing the circuit breaker of FIG. 11 where the cradle component is illustratively described in the off position in accordance with the present principles.

Referring to FIG. 12, when a user cycles the handle 102 between on and off, the cradle 111 remains stationary because of the support from the cradle latch 127.

Figure 13:
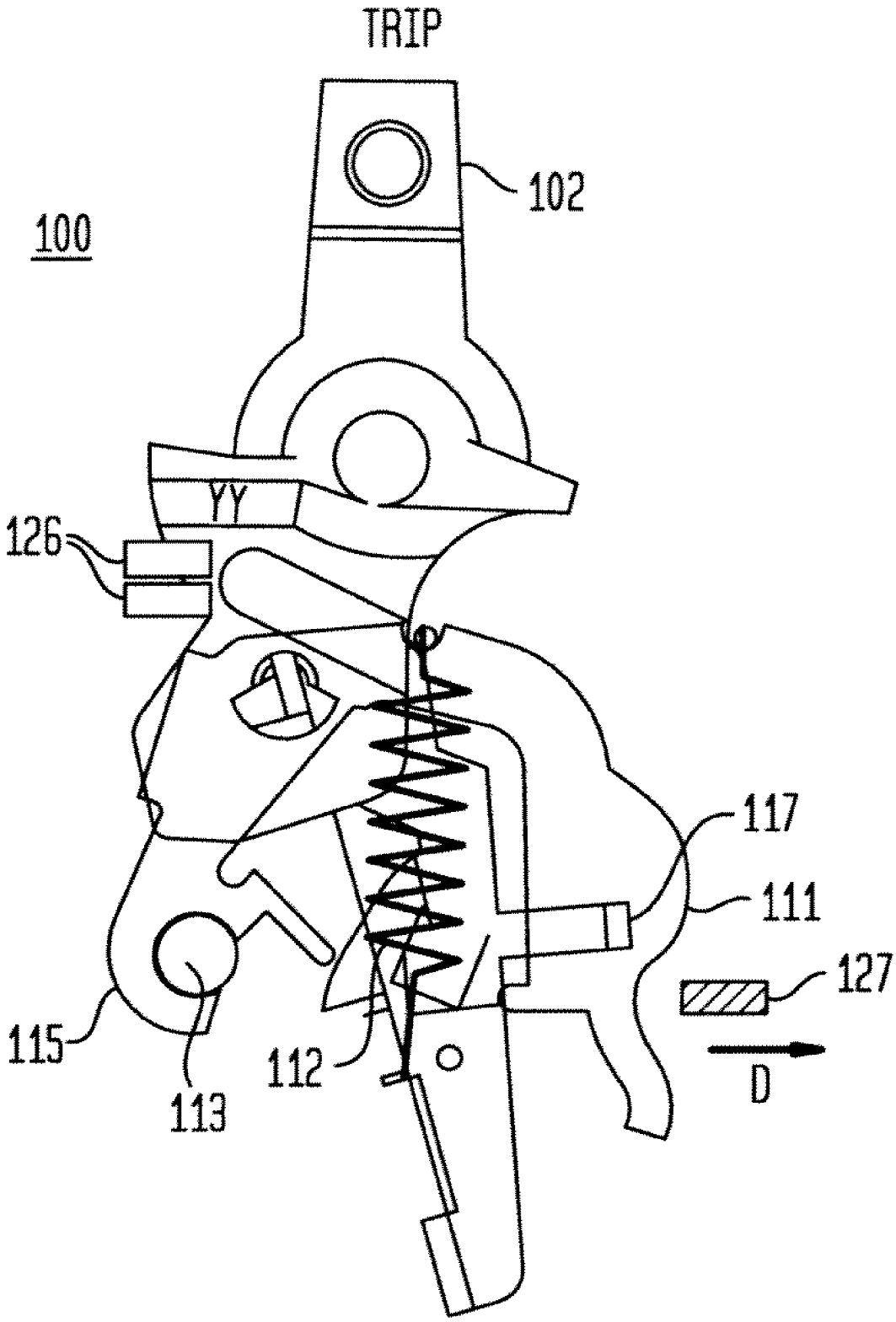
FIG. 13 is a schematic diagram showing the circuit breaker of FIG. 12 where the cradle component is illustratively described in the trip position in accordance with the present principles.

Referring to FIG. 13, when an overload current occurs, the mechanisms inside the breaker retract the latch 127 in the direction of arrow "D". As a result, the cradle 111 rotates clockwise, and the breaker goes from the on position to the trip position. Normally, a stop is provided inside the breaker to define how far the cradle can rotate.

Having described preferred embodiments for circuit breaker locking and unlocking mechanism (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A circuit breaker, comprising:

main contacts configured to connect in an on position and be separated in an off position;

a handle coupled to one of the main contacts to adjust the contacts between the on position, the off position, a trip position and an over on position;

secondary contacts configured to provide power when connected using the handle in the over on position, even when the main contacts are separated; and a stop mechanism configured to maintain separation between the main contacts to enable testing using the secondary contacts to power a test circuit such that if a test passes, the stop mechanism is released to permit resetting of the main contacts.

2. The circuit breaker as recited in claim 1, wherein the main contacts include a fixed contact and a moveable contact, the moveable contact being provided on a moving arm which separates the moveable contact from the fixed contact when the breaker is tripped.

3. The circuit breaker as recited in claim 2, wherein the moving arm includes a latch configured to engage the stop mechanism when the handle is positioned in a set position.

4. The circuit breaker as recited in claim 2, wherein the stop mechanism includes a magnetic material and is actuated in accordance with a magnetic field to release the moving arm.

5. The circuit breaker as recited in claim 4, wherein the stop mechanism is actuated by a relay responsive to a signal of the test circuit.

6. The circuit breaker as recited in claim 2, wherein the stop mechanism includes a moveable latch to lock and unlock the stop mechanism.

7. The circuit breaker as recited in claim 6, wherein the moveable latch is actuated by a solenoid plunger responsive to a signal of the test circuit.

8. The circuit breaker as recited in claim 2, further comprising an over center position of the handle such that the moving arm engages the stop mechanism to prevent reconnection of the first contacts until the test is performed.

9. A circuit breaker, comprising:

a moving arm having a moveable contact connecting to a fixed contact when in an on position and separated from the fixed contact in an off position;

a handle coupled to the moving arm to adjust the moving arm into the on position, the off position, a trip position and an over on position;

secondary contacts configured to provide power to a test circuit, the secondary contacts being connected by the handle when in the over on position; and a moving arm stop configured to maintain separation between the moveable contact and the fixed contact when the handle is in the over on position, the moving arm stop being releasable in accordance with a signal from the test circuit generated when the secondary contacts are connected such that the moving arm stop releases the moving arm if the test circuit determines that the breaker is suitable for operation.

10. The circuit breaker as recited in claim 9, wherein the moving arm includes a latch configured to engage the stop mechanism when the handle is in a set position.

11. The circuit breaker as recited in claim 9, wherein the stop mechanism includes a magnetic material and is actuated in accordance with a magnetic field to release the moving arm.

12. The circuit breaker as recited in claim 11, wherein the stop mechanism is actuated by a relay responsive to the signal of the test circuit.

13. The circuit breaker as recited in claim 9, wherein the stop mechanism includes a moveable latch to lock and unlock the stop mechanism.

14. The circuit breaker as recited in claim 13, wherein the moveable latch is actuated by a solenoid plunger responsive to the signal of the test circuit.

15. The circuit breaker as recited in claim 9, further comprising an over center position of the handle such that the moving arm engages the stop mechanism to prevent reconnection of the moveable and fixed contacts until the test passes.

16. A method for powering circuit breaker electronics, comprising:

providing a circuit breaker having connectable main contacts wherein the main contacts connect in an on position and are separated in an off position and a trip position, a handle coupled to one of the main contacts to adjust the contacts between the on position, the off position and an over on position, secondary contacts configured to provide power when connected using the handle in the over on position, and a stop mechanism configured to maintain separation between the main contacts until a condition is met;

connecting the secondary contacts by applying the handle in the over on position; and powering a circuit within the circuit breaker such that if the condition is met as determined by the circuit, the stop mechanism is released to permit resetting of the connectable main contacts, otherwise the stop mechanism is maintained and the main contacts remain separated.

17. The method as recited in claim 16, further comprising engaging a moving arm used to separate the main contacts with the stop mechanism when the handle is a set position.

18. The method as recited in claim 17, further comprising actuating the stop mechanism in accordance with a signal output from the circuit to release the moving arm.

19. The method as recited in claim 18, wherein the stop mechanism is actuated by one of a relay and a solenoid plunger responsive to the signal of the circuit.

* * * * *